United States Patent [19]

Littleton

[11] Patent Number: 4,652,197

[45] Date of Patent: Mar. 24, 1987

[54] SHEET COUNTER AND STACKER SYSTEM

[75] Inventor: Francis J. Littleton, Buffalo, N.Y.

[73] Assignee: Littleton Industrial Consultants, Inc., Buffalo, N.Y.

[21] Appl. No.: 704,676

[22] Filed: Feb. 22, 1985

[51] Int. Cl.[4] ..... B65H 31/32

[52] U.S. Cl. ..... 414/50; 198/423; 198/425; 198/503; 271/188; 271/218; 377/8; 414/786; 414/901

[58] Field of Search ..... 414/50, 901, 786; 271/188, 202, 203, 218; 198/423, 425, 503; 377/8, 53

[56] References Cited

U.S. PATENT DOCUMENTS

| | | | |
|---|---|---|---|
| 2,205,767 | 6/1940 | Lamb | 271/218 X |
| 2,708,863 | 5/1955 | Payne . | |
| 2,787,363 | 4/1957 | Howdle | 198/503 X |
| 2,853,299 | 9/1968 | Link et al. . | |
| 3,054,516 | 9/1962 | Joa . | |
| 3,096,978 | 4/1963 | Jendrusch . | |
| 3,169,646 | 2/1965 | Mason . | |
| 3,295,703 | 1/1967 | Schiepe . | |
| 3,362,707 | 1/1968 | Lauren . | |
| 3,529,168 | 9/1970 | Guggisberg | 198/423 X |
| 3,543,651 | 12/1970 | Donahue et al. . | |
| 3,566,757 | 3/1971 | Fujishiro . | |
| 3,567,046 | 3/1971 | Reist . | |
| 3,568,578 | 3/1971 | Fujishiro . | |
| 3,599,805 | 8/1971 | Spencer et al. | 271/218 X |
| 3,683,758 | 8/1972 | Feldkamper . | |
| 3,737,666 | 6/1973 | Dutro | 198/503 X |
| 3,785,256 | 1/1974 | Nikkel . | |
| 3,834,289 | 9/1974 | Behrens et al. . | |
| 3,887,013 | 6/1975 | Helberg . | |
| 3,948,153 | 4/1976 | Dutro et al. | 198/423 |
| 4,006,831 | 2/1977 | Jimenez . | |
| 4,111,411 | 9/1978 | Graves et al. | 271/202 X |
| 4,189,133 | 2/1980 | Arrasmith et al. . | |
| 4,323,768 | 4/1982 | Uchida . | |
| 4,359,218 | 11/1982 | Karis | 271/218 X |

FOREIGN PATENT DOCUMENTS

| | | | |
|---|---|---|---|
| 58-54490 | 3/1983 | Japan | 377/8 |
| 2104263 | 3/1983 | United Kingdom | 377/8 |

*Primary Examiner*—Leslie J. Paperner

*Attorney, Agent, or Firm*—Neuman, Williams, Anderson & Olson

[57] ABSTRACT

A system for counting and stacking a continuous stream of shingled or overlapping sheets in which the shingled sheets are transported by a first conveyor and fed into an optical counting means for individually counting the sheets. From the optical counting means, the sheets are fed into a second conveyor which imparts a concave transverse bow to the sheets thereby providing rigidity to the sheets. The sheets exit the second conveyor and are collected by a recovery means for stacking. The second conveyor further includes an insertion means activated by the optical counter for separating the stream of sheets. The action of the insertion means separates the stream of sheets so that a predetermined number of sheets are collected and stacked by the receiving means while the insertion means temporarily supports the continuing stream of sheets. After removal of the completed stack of sheets, the insertion means retracts to its original position thereby transferring the newly forming stack of sheets to the receiving means without interrupting the continuous stream of sheets.

18 Claims, 9 Drawing Figures

SHEET COUNTER AND STACKER SYSTEM

BACKGROUND OF THE INVENTION

1. Field of Invention

The present invention relates to an improved system for counting and stacking sheets of paper or signatures and would normally be used in conjunction with a printing process. In the printing process, a continuous sheet or web of paper is processed by first passing it through the printing process; second, passing it through an oven to dry the web and remove solvents and ink resins; third, passing the web through a folding and cutting system to transform the printed web into a series of shingled or overlapping individual sheets; and, finally, conveying the shingled sheets into a counting and stacking system to count and stack the sheets into stacks of a predetermined number of sheets.

It is desirable to provide a counting and stacking system in which the counting means controls the operation of the stacker and which stacker also provides an improved means for separating and stacking preselected quantities of sheets in such a way as to avoid jamming the system. Previous stacking systems which did not employ any type of counting means would normally be controlled or operated by the delivery or folding system which feeds into the stacker. Under such an arrangement, however, the stacker would continue operating as long as the delivery or folding system was operating. With the present invention, the stacker can be actuated by the sheet counting means which can shut down the stacker when the flow of sheets is completed. Operation in this manner avoids the necessity of employing labor to solely operate the stacking system.

The prior art discloses various types of devices for stacking sheets. Particularly, these prior devices make use of wedges or other insertion means to separate the continuous flow of sheets into distinct stacks by inserting the wedge in the direction opposite sheet flow. See, U.S. Pat. Nos. 3,566,757 and 3,568,578. The inherent problem in separating sheets in a direction opposite sheet flow is that such a method of separation creates a high probability of lead edge fouling or inaccurate segregation of sheets.

Other prior art devices separate sheets from beneath and in the same direction of sheet flow. However, these devices employ more than one insertion means. See, U.S. Pat. No. 2,853,299, U.S. Pat. No. 4,359,218 and U.S. Pat. No. 4,111,411. The present invention overcomes the problems and limitations associated with these prior devices and improves upon the prior art stackers by achieving separation and stacking of the sheets through the use of a single insertion device from beneath and in the direction of sheet flow.

The preferred embodiment of the present invention also employs an optical counting system to count the sheets. A transmitter emits a beam of light which, when interrupted, causes a counter to register a counted unit. Optical counters have been previously used to count sheets as seen in U.S. Pat. No. 3,834,289. However, the present invention improves upon previous optical counting arrangements. In U.S. Pat. No. 3,834,289, for example, the feed conveyor is angled and is required to be elevated above the conveyor discharging the sheets from the counter. The present invention alleviates all of the common problems associated with angled and duel level conveyors by using a level conveyor system while still achieving accurate counting.

OBJECTS OF THE INVENTION

It is a general object of this invention to provide an improved sheet counting and stacking system for use in connection with printing processes.

It is a further object of this invention to provide an improved stacking means.

It is another object of this invention to provide an improved means for individually and accurately counting sheets.

It is another object of this invention to provide stacking means which separates the continuous flow of sheets from beneath and behind the sheets and which additionally bows the shingled sheets thereby making separation of predetermined quantities of sheets accurate and less susceptible to jamming and which further imparts an increased stiffness to the sheets.

It is still a further object of this invention to control operation of the improved stacking means by means of an optical sheet counter.

SUMMARY OF THE INVENTION

In accordance with one embodiment, a continuous stream of shingled sheets is caused to travel by a first conveyor at a constant, slow speed relative to the speed of the web exiting the printing press. The sheets then enter a counting means wherein the stream of sheets are forced beneath a roller and are individually counted as the trailing edge of each sheet is flipped down to interrupt an optical counter. The optical counter can also serve as a control for the subsequent stacker system. That is, when no shingles are present to be counted as sensed by the optical counter, the stacker may be shut down.

From the counter, the continuous shingled stream of sheets is carried over a second multi-belt conveyor. This second conveyor section includes driven belts as well as driven and guide rollers at each side of the sheet path, angled inwardly to impart a transverse bow to the sheets. This conveyor is also provided with an intermediate deck plate to assist in support of the center of the bowed sheets. The center portion of the deck plate is formed by an elongated spade with a forward nose disposed at the exit end of the second conveyor. The spade, in its resting position, extends for a distance less than the full length of the second conveyor.

As the bowed and shingled sheets are transported along the second conveyor and over the forward nose of the elongated spade, the trailing edges of the bowed sheets snap downwardly past the nose of the spade. Because the sheets are no longer supported beneath their centerline at this point, the sheets bow even further creating a pocket between the sheet which has completely passed over the spade and the next trailing sheet which has not yet snapped downwardly past the nose of the spade. The sheets then exit the second conveyor and fall upon a sheet receiving means where jogging means maintain an even alignment in the individual sheets.

When a predetermined number of sheets have been counted, the elongated spade is activated. The spade extends in the direction of sheet flow and is inserted into the pocket formed between the trailing edge of the last sheet to flip past the nose of the spade and the following sheet that is still supported by the nose of the spade. The spade may be operated by means of a piston-cylinder arrangement as is well known. Under the actuation of the optical counter, the spade periodically reciprocates to separate the sheet stream into stacks of preselected quantities.

The spade continues its horizontal extension into the sheet stream until it contacts a limit switch, at which position the spade will be directly over the sheet receiving means. A typical embodiment of the sheet receiving means may be an air table. The extended spade provides a temporary floor on which the continuing flow of sheets can form a new stack. Both the spade, with the newly forming stack, and the air table, with the completed stack of sheets, are lowered. The spade is lowered so that the height of the newly forming stack does not surpass the plane of the second conveyor, thereby jamming the system. The air table is lowered until it is slightly above a second sheet receiving means or stack transport table. The stack transport table also may typically be an air table. The completed stack is removed from the air table or relocated to the second air table by movement of a second piston-cylinder arrangement. The spade then retracts to its original position leaving the uncompleted stack of sheets on the air table to form a completed stack.

BRIEF DESCRIPTION OF THE DRAWINGS

For a more complete understanding of this invention, reference should now be made to the embodiment illustrated in greater detail in the accompanying drawings and described below by way of examples of the invention.

In The Drawings

DETAILED DESCRIPTION

The relationship and workings of the various elements of this invention will be better understood by the following detailed description. However, the embodiment of the invention described below is by way of example only and applicant does not limit himself to this embodiment. Furthermore, one should understand that the drawings are not to scale and that the embodiments are illustrated by graphic symbols and fragmentary views. In certain instances, the applicant may have omitted details which are not necessary for an understanding of the present invention such as conventional details of fabrication and assembly.

Generally, the device of this invention counts and stacks sheets of printed material and is intended to be integrated into a full service printing system. The device of this invention will follow the actual printing and folding and cutting operation and will receive a continuous stream of shingled or overlapping sheets for counting and stacking into predetermined quantities. Subsequent to stacking, but not a part of this invention, the sheets would generally be bundled in some manner for easy handling and movement.

As the shingled sheets are received by the invention, they travel by a first conveyor means where they are then fed into the optical counting means for counting. After exiting the counting means, the sheets enter a second conveyor means where a transverse bow is imparted to the sheets. The sheets travel along the second conveyor in bowed relation and exit the second conveyor where they fall individually onto a sheet receiving means. The sheet receiving means acts as a table on which the stack of sheets forms. When the predetermined number of sheets have been counted, an elongated spade underlying the second conveyor extends into the stream of overlapping sheets. The space acts as a temporary sheet receiving means while the completed stack is removed from the actual sheet receiving means.

Figure 2A:
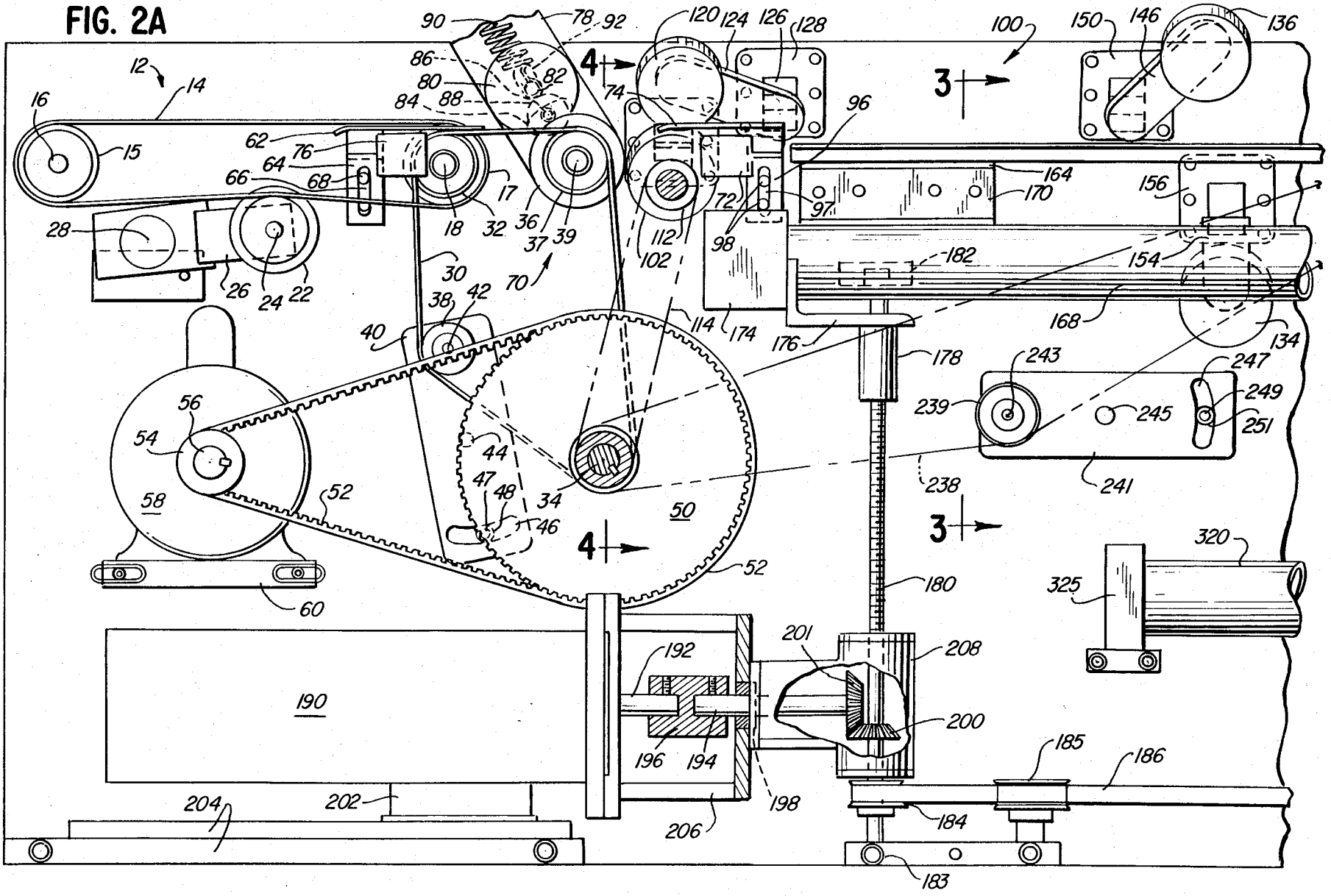
FIG. 2A is a cross-sectional side view of the counting means and a portion of the stacking means.
Figure 2B:
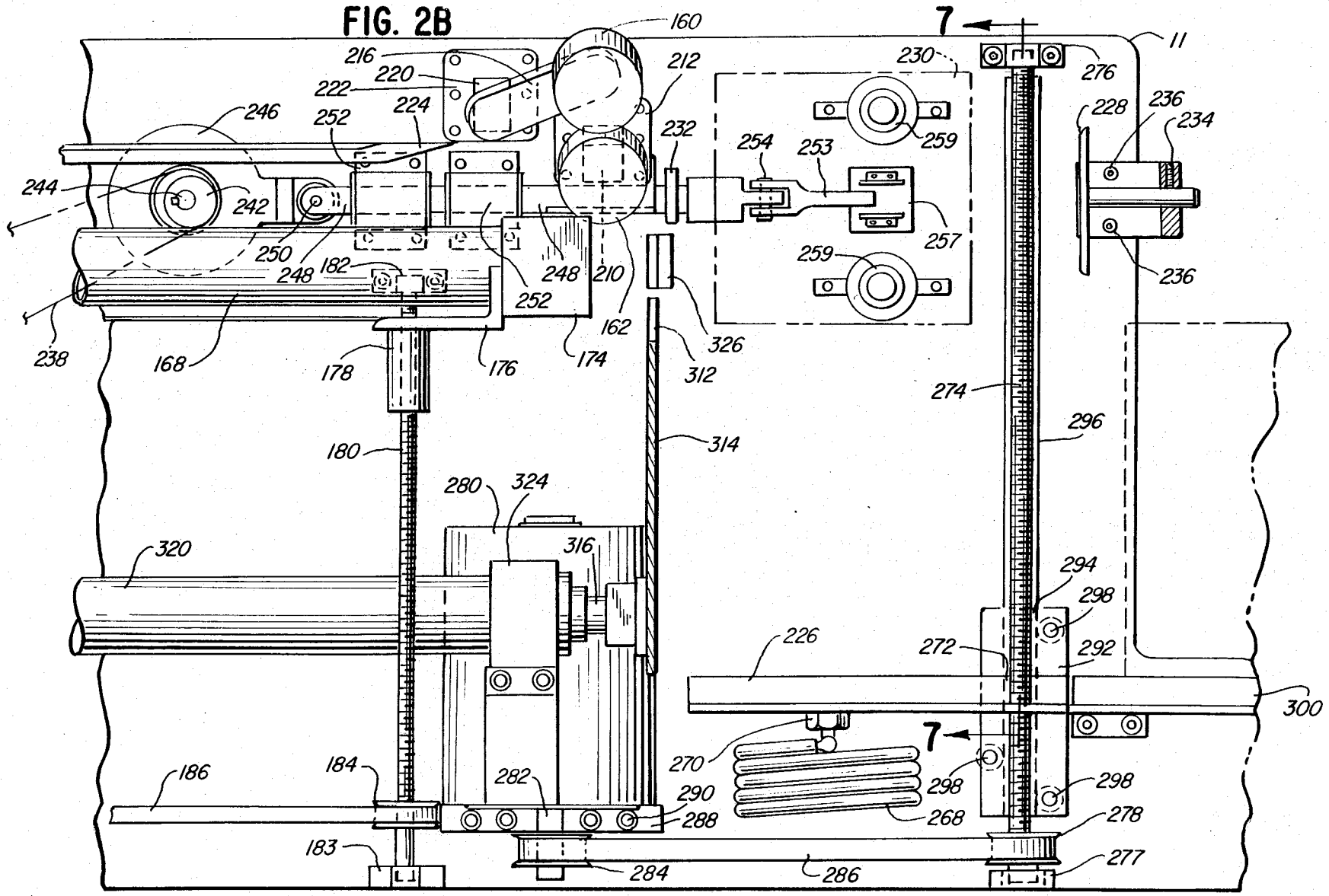
FIG. 2B is a cross-sectional side view of the remainder of the stacking means not shown in FIG. 2A.

It should be understood that many of the elements depicted in the cross-sectional drawings of FIGS. 2A and 2B are symetric about the centerline of the sheet counter and stacker system. It is inherent with respect to these elements that duplicative elements exist on the opposite side of the conveyor which are not shown in FIGS. 2A and 2B but which appear in the other figures. In those instances, the elements are described only once but are referenced in plural rather than singular to indicate the existence of duplicative elements.

Described in more detail, a stream of flat shingled sheets, wherein the leading edge of each sheet overlaps the tail of the preceding sheet, is fed into the counter and stacker system 10 of this invention (FIG. 1) by means of a first (FIG. 2A) conveyor 12 comprising a series of flat belts 14 traversing a guide roller 15 and drive roller 17. Both the guide roller 15 and the drive roller 17 are rotatably mounted to the frame 11 by means of axles 16 and 18, respectively, and the drive roller 17 has a channel cut through the center (not shown). The belts 14 are further subject to variable tensioning by means of adjustably positionable pulleys 22 rotatably attached to a shaft 24, which engage arms 26 pivotally mounted to the frame 11 by pins 28. The belts 14 are driven by the drive roller 17 which, in turn, is driven by a belt 30 operably engaging a pulley 32 and rotatably engaging a pulley 33 attached to a main drive shaft 34. This belt 30 drives still another roller 36 by means of a pulley 37 affixed to the axle 39 of the roller 36 which forms a part of the sheet counting means 70 discussed in detail below. The surfaces of the pulleys 32 and 37 are recessed below the surfaces of the drive roller 17 and other roller 36, respectively, so not to interfere with the movement of the shingled sheets.

The belt 30 is tensioned by means of a pulley 38 rotatably attached to one end of a tensioning bracket 40 by a pin 42. The pulley 38 is adjustably positionable by pivotal movement of the bracket 40 about a pin 44 fixably attached to the frame 11. An arcuate slot 46 at the opposite end of the bracket 40 through which extends a threaded lug 47, fixably attached to the frame 11, limits movement of the bracket 40. A lug nut 48 receptively engages the lug 47 and locks the tensioning bracket 40 in position.

The main drive shaft 34 is caused to rotate by the movement of a main timing belt pulley 50, suitably key connected to the main drive shaft 34. The main timing belt pulley 50 is driven by a timing belt 52 which engages a second gear 54 that is key connected to the shaft 56 of a belt drive motor 58. The timing belt 52 is tensioned by adjustably positioning the motor 58 by means of the adjustable motor mounting bracket 60.

The shingled sheets are supported in movement between the guide roller 15 and drive roller 17 by the belts 14. Disposed directly above the drive roller 17 and laterally between the belts 14 is a guide plate 62 with a downwardly curved leading edge for easily receiving the flow of shingled sheets and for supporting the sheets immediately preceding the entry of the sheets into the counting means 70. The guide plate 62 is mounted to the frame 11 by a bracket 64 which has a longitudinal slot 66 for vertically positioning the guide plate 62 on the threaded lugs 68 which are fixably attached to the frame 11 and extend through the slot 66.

Figure 1:
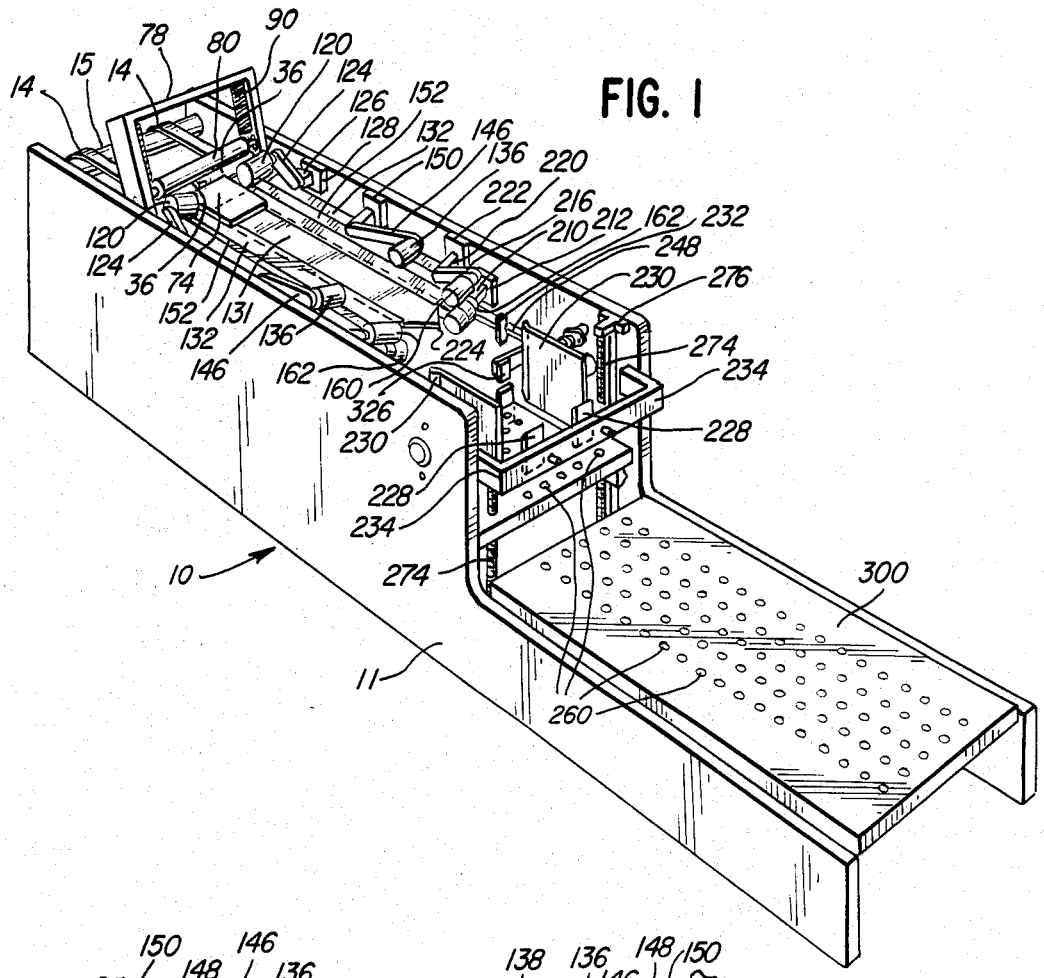
FIG. 1 is a perspective view of the sheet counter and stacker system of this invention.
Figure 8:
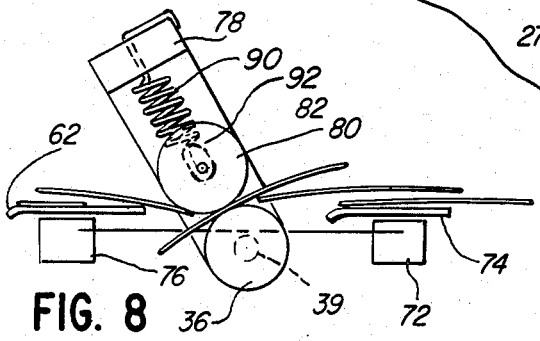
FIG. 8 is a cross-sectional side view of the optical counting means.

As seen additionally in FIG. 8, the optical counting means 70 is comprised of a photoelectric transmitter 72 fixably attached to and subtending the entry guide plate 74 of a second conveyor 100 and a receiver 76 fixably attached to and subtending the guide plate 62, and a positionable frame 78 supportably housing a drive roller 36 disposed below an impinging roller 80, both rotatable about respective axles 39 and 82 operably connected to the frame 78. Of course, it is understood that the respective positions of the photoelectric transmitter and receiver may be reversed. The drive roller axle 39 further extends through the frame 78 and is mounted to each side of the main frame 11. The sides of the frame 78 have a pair of arcuate shaped slots 84 through which a threaded lug 86 mounted to the main frame 11 is positioned. The frame 78 is free to pivot about the axle of the drive roller 39 limited by the interaction of the lug 86 and the slot 84. The frame 78 is locked in place by a lug nut 88 tightened about the lug 86. The impinging roller 80 is spring loaded by springs 90 affixed to the upper portion of the frame 78 and the impinging roller axle 82 to be subject to a constant downward force relative to the sides of the frame 78 (FIGS. 1, 2A). The ends of the impinging roller axle 82 ride in a second pair of slots 92 provided in the sides of the frame 78 allowing translational movement of the impinging roller relative to the sides of the frame 78.

Drive is imparted to the lower roller 36 by means of the belt 30 which drives the first conveyor 12. A pulley 37 mounted on one end of the drive roller axle 39 engages the belt 30 which is powered by the main drive shaft 34. A channel found in the center of the drive roller 36 allows light emitted from a photoelectric transmitter 72 to pass through and be received by a photoelectric receiver 76.

In operation, the flat shingled sheets cross the guide plate 62 with each successive leading edge forced between the drive roller 36 and the impinging roller 80. As seen in FIG. 8, the relative positioning of the drive roller 36 and the impinging roller 80 by adjustable positioning of the frame 78, as explained above, cause the sheets to be forced beneath the impinging roller 80 and then over the drive roller 36. The action of the impinging roller 80 flattens the spine of the sheets created during a prior folding operation.

Often the sheets will collect static from handling prior to entering the sheet counter and stacker system of this invention. Depending on the polarity, this static can push the sheets apart or force them together creating fouling problems in the system. The static is minimized, however, by the positioning of the rollers so that as the sheets travel between the impinging roller 80 and the drive roller 36 the respective leading edges are driven upwardly introducing air back between the successive sheets. This upward movement of the leading edge of the sheets, together with the positioning of the guide plate 62 cause each trailing edge of each succeeding sheet to be flipped down as the sheet leaves the guide plate 62, thereby briefly interrupting the light beam emitted from the photoelectric transmitter 72 and causing the sheets to be individually counted. Alternatively, by positioning the frame 78 in an upright or vertical position, i.e., with the impinging roller 80 directly vertically above the drive roller 36, the trailing edge of the sheets are not flipped down and, therefore, the sheets are not counted. This allows the operator to run waste or test sheets through the machine without needing to reset the counting mechanism.

Figure 4:
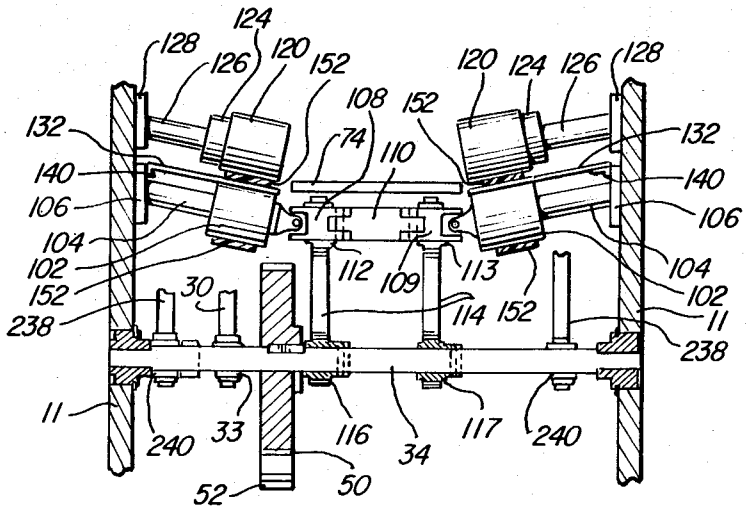
FIG. 4 is an incomplete cross-sectional view taken along line 4—4 of FIG. 2A.

A transverse bow is imparted on the flat stream of shingled sheets as they are received by the entry guide plate 74 of a second conveyor 100 and fed into an initial dual pair of angled rollers 120 and 102 (FIGS. 2A, 4). The guide plate 74 is mounted to the frame 11 by a bracket 96 which has a longitudinal slot 97 for vertically positioning the guide plate 74 on the threaded lugs 98 which are fixably attached to the frame 11 and extend through the slot 97. The dual pair of rollers are comprised of bottom rollers 102 which are rotatably mounted on inwardly angled shafts 104 which, in turn, are attached to frame 11 by brackets 106. A pair of universal joints 108 and 109 are attached to the rollers 102 and are interconnected for unison movement by axle 110. The universal joints 108 and 109 engage the center of pulleys 112 and 113 and are driven by belts 114. The belts 114 are, in turn, driven by a second set of pulleys 116 and 117 attached to and driven by the main drive shaft 34. In complemental relationship to the rollers 102 is a pair of floating guide rollers 120. These guide rollers 120 rotate freely about one end of the arms 124. The other end of arms 124 pivot about inwardly angled posts 126 mounted to frame 11 by brackets 128 allowing the rollers 120 to be lifted off of the surface of the second conveyor 100 providing unobstructed access to the shingled sheets. The transverse bow adds rigidity and strength to the sheets not characteristic in a stream of flat sheets.

Figure 3:
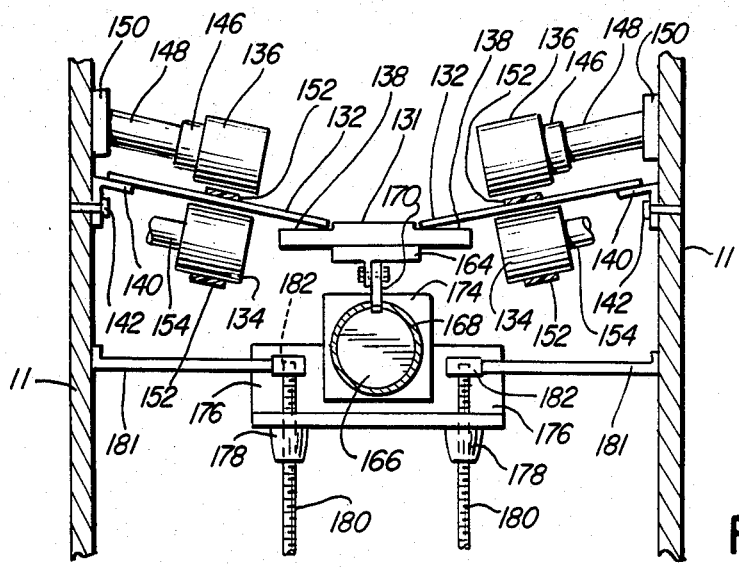
FIG. 3 is an incomplete cross-sectional view taken along line 3—3 of FIG. 2A.

As seen in FIG. 3, the transverse bow imparted to the sheets is maintained in the second conveyor 100 by means of an intermediate deck plate 130, two side deck plates 132 and a second dual pair of rollers 134 and 136. A cut out portion 138 runs the length of the deck plate 130 on each side defining a raised, elongated spade shaped member 131 and further allowing the surfaces of the side deck plates 132 to align evenly with the surface of the spade 131. The side plates 132 are positioned by angled brackets 140 affixed to the frame 11 by bolts 142. The upper floating guide rollers 136 are rotatably mounted to one end of the arms 146. The other end of the arms 146 pivot about the end of inwardly angled posts 148 to allow the upper rollers 136 to be lifted off the surface of the second conveyor 100 providing access to the sheets. The posts 148 are fixed to the frame 11 by brackets 150. The bowed sheets are transported along the support plates by means of flat belts 152 which encircle the drive rollers 102 (FIG. 4), the side plates 132, the end rollers 162 and the lower guide rollers 134.

The lower guide rollers 134 are rotatably mounted on the ends of inwardly angled posts 154. The posts 154 are fixed to the frame 11 by brackets 156.

Figure 5:
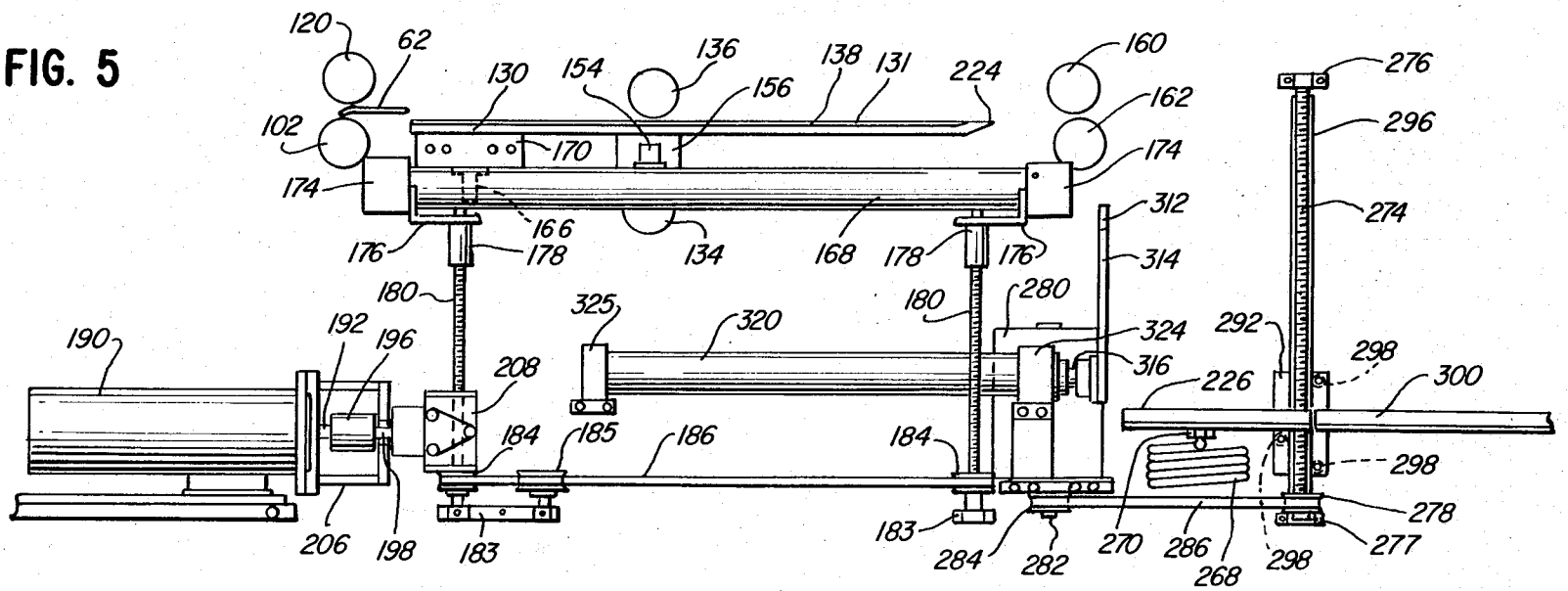
FIG. 5 is an incomplete cross-sectional side view of the operative elements comprising the stacking means of this invention.

Subtending and attached to the intermediate deck plate is a "T" bracket 164 which is operably connected to a piston 166 disposed within a cylinder 168 by an interconnecting plate 170 which reciprocates in a self sealing slot (not shown) running the length of the upper surface of the cylinder 168. A piston-cylinder structure of this type is manufactured by Origa, No. 120S-20, having an eighteen-inch stroke. Disposed at each end of the cylinder 168 (FIGS. 2A, 2B, 5) are end blocks 174 which receive pressurized air from an air source (not shown). These brackets are affixed to support brackets 176. Subtending each support bracket 176 are two internally threaded bushings 178 (FIGS. 2A, 2B, 3) which receptively engage threaded shafts 180 and are freely rotatable in brackets 182 and 183. The brackets 182 are secured to the frame 11 by the mounting plates 181. Attached to each threaded shaft 180 directly above the respective base mounting brackets 183 are four pulleys 184 interconnected by a belt 186. Belt 186 is tensioned by an adjustably positionable pulley 185 mounted in one of the base brackets 183 (FIG. 2A). Driving any one of the four threaded shafts 180 will uniformly rotate all four shafts 180 thereby engaging the bushings 178 and ascendingly or descendingly positioning the cylinder 168. As seen in FIG. 2A, one of the four threaded shafts 180 is driven by a variable speed, reversible motor 190 through the rotation or counter rotation of the motor shaft 192 operably connected to a snub shaft 194 by a coupling 196, which snub shaft 194 rotates within a bearing sleeve 198 and drives right angle bevel gears 200 and 201 causing the threaded shaft 180 to rotate. The motor 190 is supported by a pedestal 202 and positionably attached to the frame 11 by base plates 204. The motor shaft 192 and right angled gears 200 and 201 are disposed within protective housings 206 and 208. Accordingly, the entire piston cylinder and intermediate deck plate structure is vertically positioned within the frame 11.

Figure 6:
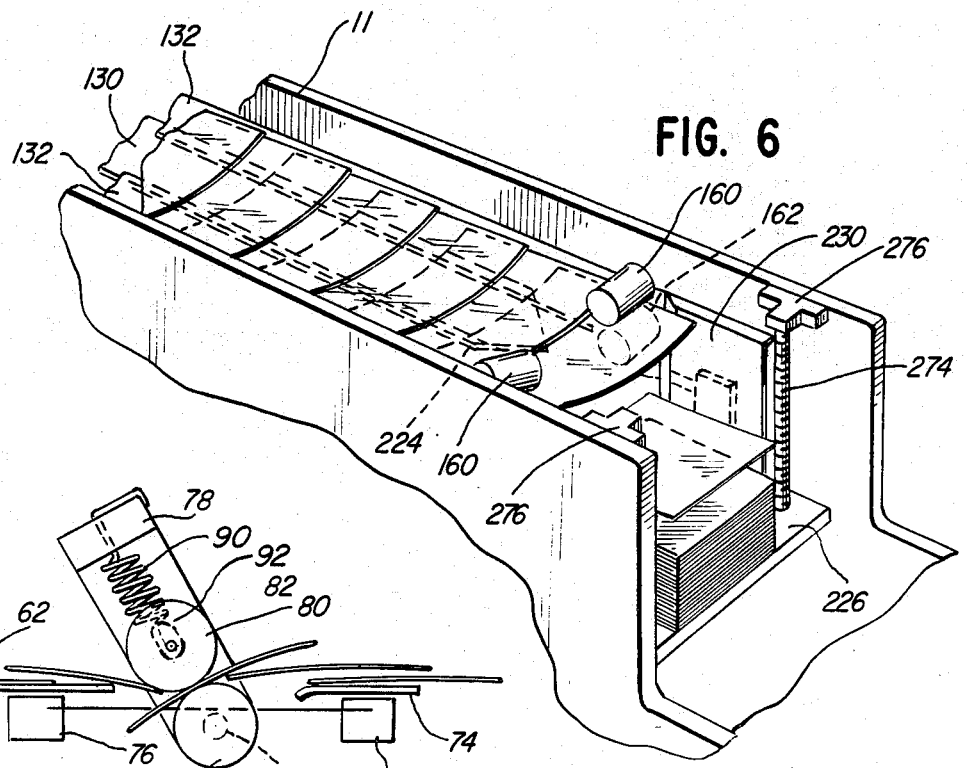
FIG. 6 is an incomplete perspective view of the stacking means of this invention.

As seen in FIGS. 1 and 6, a third dual pair of rollers 160 and 162 are disposed at the end of the second conveyor 100. The bottom rollers 162 are rotatably mounted on downwardly angled posts 210 attached to the frame 11 by brackets 212. Upper rollers 160 freely rotate about one end of arms 216. The other end of arms 216 pivot about inwardly angled posts 220 mounted to the frame 11 by brackets 222 to allow the upper rollers 160 to be lifted off the surface of the second conveyor 100 thereby providing access to the shingled sheets.

In operation, the shingled sheets are fed onto the second conveyor from the optical counting means wherein they conform to the shape of the side plates 132 and the elongated spade 131 by the action of the initial dual pair of rollers 120 and 102. This imparts a concave transverse bow to the shingled sheets. The spade 131 prevents the bowed sheets from attaining a true parabolic shape by providing a flat centerline support to the bowed sheets. The spade 131 has a forward nose 224 which terminates prior to the end of the side plates 132. As the sheets travel past the forward nose 224, supported in bowed position by the side plates 132 and the third dual pair of guide rollers 160 and 162, the trailing edge of each succeeding sheet is caused to snap down over the forward nose 224 as the center support is lost. The loss of the center support enables the bowed sheets to achieve a parabolic shape.

The shingled sheets are propelled out of the second conveyor 100 wherein the individual sheets hit the front stops 228 and fall upon a sheet receiving means 226. The sheets are confined during the fall by front stops 228, side joggers 230 and back joggers 232. The front stops 228 are affixed to a front frame mount 234 which is attached to the frame 11 by bolts 236. In addition to confining the movement of the falling sheets, the side joggers 230 and the back joggers 232 neatly position the sheets on the receiving means 226. The joggers oscillate by means well known to those of skill in the art from motion of the main drive shaft 34 transferred to the joggers by a belt and pulley system. In the embodiment shown in FIG. 2B, which does not show the duplicative jogging means on the other side of the apparatus, belts 238 operatively engaged to the main drive shaft 34 by pulleys 240 (FIG. 4) rotate the eccentrically mounted shafts 242 about the axles 244 creating unison movement in the followers 246 pivotally connected to one end of the rods 248 by the pins 250. The rods 248 linearly reciprocate within cylindrical guides 252 (FIG. 2B) similarly creating reciprocal movement in the back joggers 232 which are affixed to the rods 248. The opposite end of the rods 248 are pivotally attached to the arms 253 by pivots 254. The side joggers 230 are interconnected to the arm 253 by brackets 257. Additional jogging support means 259 aid in the movement of the side joggers 230. Accordingly, linear movement of the rods 248 is translated through the arms 253 to oscillate the side joggers 230. The belt 238 is tensioned by means of a pulley 239 rotatably attached to one end of a tensioning bracket 241 by a pin 243. The pulley 239 is adjustably positionable by pivotal movement of the bracket 241 about a pin 245 fixably attached to the frame 11. An arcuate slot 247 at the opposite end of bracket 241 through which extends a threaded lug 249, fixably attached to the frame 11, limits movement of the bracket 241. A lug nut 251 receptively engages the lug 249 and locks the tensioning bracket 241 in position.

The receiving means 226 has two internally threaded bores 272 which receptively engage two threaded shafts 274. Each threaded shaft 274 is securely mounted to the frame 11 by brackets 276 and 277, each bracket having a recessed seat allowing the shafts 274 to rotate therein. A pair of pulleys 278 are attached to the base of the shafts slightly above the base frame brackets 277. A reversible, variable speed motor 280 vertically translates the position of the receiving means 266 by means of an output shaft 282 with a pulley 284 affixed thereon and a belt 286 interconnecting the pulleys 278 disposed at the bottom of the two shafts 274. The motor 280 is mounted on the frame 11 by a mounting bracket 288 and four bolts 290. Because the receiving means 226 is cantilevered from the threaded shafts 274 a certain amount of wobbling would occur during movement of the receiving means 226. This problem is avoided by vertical support brackets 292 affixed to the receiving means 226 containing a vertical channel 294 for receptively engaging guide bars 296 by bearing elements 298. The guide bars are affixed to the frame 11 and this entire structure provides stability in movement of the receiving means 226.

In its preferred embodiment, the receiving means 226 may be an air table with a grid of cylindrical bores 260 in which are maintained ball (not shown). Such an air table is of known construction and assembly to those with ordinary skill in the relevant art. Air pressure is supplied to the air table from an air source (not shown)

by means of a flexible hose 268 attached to the air supply at one end and attached to the air table by a pneumatic coupling 270 at the other end. Thus, the ball bearings protrude slightly from the bore 260 due to the supplied air pressure, but as sheets are stacked upon the air table the ball bearings are forced down allowing the air to escape and thereby providing the bottom of the sheet stack with a cushion of air making movement of the stack easier.

The receiving means 226 is limited in movement from a position level with the bottom of the side joggers 230 to a position level with a stack transport table 300. The stack transport table 300 need only be a large flat surface but in the preferred embodiment of this invention it is an air table of similar construction as described with respect to the sheet receiving means. The stack transport table, however, is fixably mounted to the frame 11.

Figure 7:
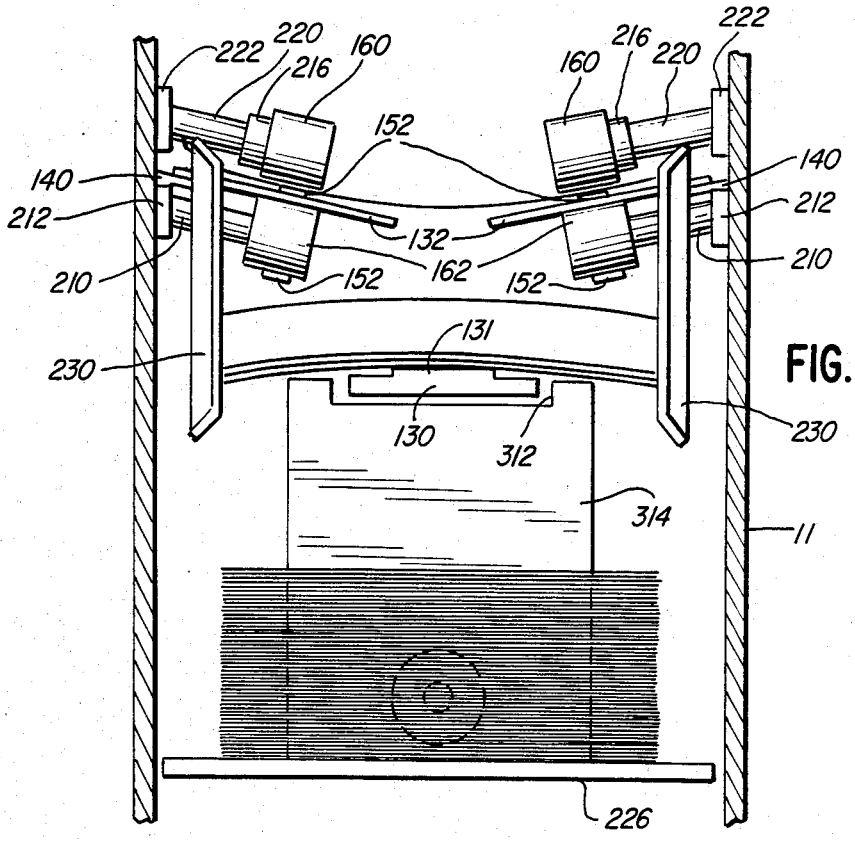
FIG 7 is an incomplete cross-sectional end view taken along line 7—7 of FIG. 2B.

In the preferred embodiment, a continuous stream of shingled sheets passes through the counter and stacker system 10. After being counted by the counting means 70, the sheets are transported by a second conveyor 100 and collect on the sheet receiving means 226. As seen more clearly in FIG. 5, the receiving means 226 descends at a preselected rate proportional to the rate of the sheets along the conveyors so that the top of the increasingly growing stack is always below the level of the second conveyor system. When a predetermined number of sheets have been counted, the counting means 70 will activate the piston 166 within the cylinder 168 interconnected to the intermediate deck plate 130 causing the forward nose 224 of the elongated spade 131 to move forward at a rate at least equal to the rate of the sheets on the second conveyor 100. The spade 131 will easily slide into the pocket formed by the trailing edge of the last sheet to snap down over the forward nose 224 and the next succeeding sheet still supported by the forward nose 224. A limit switch (not shown) stops the extension of the deck plate 130 with the forward nose 224 passing between the two front plates 228. At this point, the deck plate 130 acts as a temporary receiving means for the still continuing stream of shingled sheets. As seen in FIG. 7, the sheets overlap the deck plate 130 but do not contact any of the jogging means. This prevents any fouling of the system during the simultaneous stacking of the completed stack.

The entire deck plate 130 then descends at a rate faster than the descending receiving means 226. This allows the top of the newly forming stack on the spade 131 to be lower than the incoming sheets and further allows the deck plate 130 to compress the stack of sheets on the slower descending receiving means 226 thereby removing any air in the completed stack for subsequent bundling. Air trapped within the sheets can add several inches or more to the overall height of a stack of sheets depending upon the weight of the paper used and the height of the stack. When heavier stock paper is used, less air is trapped during stacking thereby alleviating the necessity of compressing the stack. In such a circumstance, the timing of the movement of the receiving means 226 relative to the deck plate 130 can be adjusted.

When the deck plate 130 has descended into the recess 312 of a plunger 314 (FIGS. 1 and 7), a limit switch (not shown) halts any further downward movement. The receiving means 226 continues descending until it stops slightly above the stack transport table 300. The completed stack is pushed onto stack transport table 300 by the plunger 314 which is caused to move by a piston arm 316 interconnected to a piston-cylinder structure 320 (FIGS. 1, 2B, 5, 7). The piston-cylinder structure 320 can be activated by the optical counter or by the movement of the receiving means 226 or deck plate 130. The cylinder is mounted to frame 11 by brackets 324 and 325. The cylinder is operated by known pressurized air means (not shown).

After the completed stack has been moved to the stack transport table 300 and the plunger 314 has retracted to its original position, the receiving means 226 ascends to a position just below the now stationary and fully extended spade 131. The spade 131 is then retracted by its controlling piston-cylinder structure 168 causing the sheets to drop onto the sheet receiving means 226. Additionally, the preferred embodiment includes a pair of back plates 326 mounted to frame 11 to aid in stripping the newly forming stack of sheets from the spade 131 causing the sheets to drop onto the receiving means 226. The deck plate 130 and piston-cylinder structure 168 then ascend to realign the spade 131 between the side plates 132.

While the above description only shows one embodiment of the invention, one will understand, of course, that the invention is not limited thereto since one may make modifications, and other embodiments of the principles of this invention will occur to those skilled in the art to which the invention pertains, particularly upon considering the foregoing teachings. For example, those skilled in the art will appreciate that one may run the stacker without the optical counting means operating. The counting means may either be switched off electrically or the frame 78 may be positioned perpendicular to the stream of sheets so that the trailing edges of the individual sheets are not caused to flip down and interrupt the photoelectric beam. Additionally, the counting means may be relocated to a position within the folding operation but still used to control the movement of the spade 131 during stacking.

Also, to aid in the formation of the pocket into which the spade 131 extends, it is possible to add a narrow impinging roller or other type of deflection means disposed forward of the nose 224 while in its retracted position and along the centerline of the sheets. This roller will be spring loaded downwardly from a member traversing the frame 11 and have its "at rest" position lower than the surface of the spade 131. Thus, as the sheets are still supported by the side deck plates 132 and last dual pair of rollers 160 and 162 the impinging roller will actuate the downward flip of the trailing edge of the sheets.

Moreover, it is contemplated that the present embodiment could also be used with a second conveyor that transports the sheets in a substantially flat relationship rather then bowed as in the preferred embodiment. The additional impinging roller, rather than helping form a pocket for insertion of the spade 131, will cause the entire trailing edge of each succeeding flat sheet to flip down off the conveyor while still securely positioned by the last dual pair of rollers 162 and 160. This will provide the necessary space for the spade to be inserted from below and beneath without any jamming or fouling of the system.

It is therefore contemplated by the appended claims to cover any such modification and other embodiments as incorporate those features which constitute the essential features of this invention within the true spirit and scope of the following claims.

What is claimed is:

1. A system for stacking a continuous stream of shingled sheets comprising a first conveyor means for receiving said shingled sheets, means for successively counting the individual sheets, a stacking means for collecting and stacking the sheets into completed stacks of a predetermined number of sheets, a second conveyor means disposed between said counting means and said stacking means for delivering the sheets to said stacking means, means for forming a gap between successive sheets, a single insertion and support member underlying said second conveyor means and responsive to said counting means for first separating the stream of shingled sheets upon said counting means reaching a predetermined count by extending in the direction of movement of said sheets into said gap formed in said stream of shingled sheets and then fully supporting the continuing stream of shingled sheets while the stacking means stacks the predetermined number of separated sheets into a completed stack.

2. A system for stacking a stream of shingled sheets according to claim 1, wherein said insertion and support member is a single spade positioned along the direction of travel of said stream of shingled sheets and below the sheets and having a forward end positioned upstream of said stacking means.

3. A system for stacking a stream of shingled sheets according to claim 2, wherein said spade is operatively associated with said second conveyor means to form at least a partial support for sheets being conveyed along said conveyor means prior to insertion into the stream of continuing sheets.

4. A system for stacking a stream of shingled sheets according to claim 3, wherein said second conveyor means is concavely formed along its transverse cross-section for imparting an inwardly directed bow to sheets being conveyed thereon, said concavely formed conveyor means coacting with the forward end of said spade to create a pocket between successive sheets for insertion of said spade into said pocket.

5. A system for stacking a stream of shingled sheets according to claim 4, wherein said second conveyor means maintains positive control of said shingled sheets while said sheets pass over the forward end of said spade, whereby said sheets are retained in bowed configuration so that the trailing edges of said sheets are caused to snap downwardly past the forward end of said spade creating a pocket between successive sheets into which the spade can extend to separate said stream of shingled sheets.

6. A system for stacking a stream of shingled sheets according to claim 5, wherein said stacking means includes means vertically adjustable for receiving said sheets exiting said second conveyor means, means for aligning said individual sheets on said receiving means, and mechanical means for removing said separated and stacked sheets from said receiving means.

7. A system for stacking a stream of shingled sheets according to claim 1, wherein said stacking means includes means vertically adjustable for receiving said sheets one at a time exiting said conveyor, means for aligning said individual sheets on said receiving means, and mechanical means for removing said separated and stacked sheets from said receiving means.

8. The process of stacking a stream of sheets in preselected quantities wherein a continuous flow of substantially flat sheets are shingled for unison movement by the leading edge of each sheet overlying the trailing edge of the preceding sheet; said shingled sheets being first received by a first conveyor means and transported for a distance; said sheets then exiting said first conveyor and being caused to travel through an optical counting means wherein the individual sheets are counted; said sheets then entering a second conveyor means also having an exiting end which second conveyor means imparts a transverse bow upon said sheets; said second conveyor means having an insertion means with a forward nose disposed beneath and at the exit end of said second conveyor; said bowed sheets being caused to travel over said forward nose of said insertion means with said trailing edges of said sheets being caused to snap downwardly past said nose of said insertion means; said sheets exiting said second conveyor are then collected on a receiving means; said preselected quantity of said sheets having passed said counting means, said insertion means is activated by said optical counting means and caused to extend in the direction of sheet flow, separating said sheets thereby defining a completed stack of sheets and a newly forming stack of sheets; said completed stack of sheets is caused to be removed from said insertion means retracting to its original position whereby said newly forming stack of sheets is transferred to said receiving means.

9. A system for stacking a continuous stream of shingled sheets, comprising a conveyor means for receiving said shingled sheets, said conveyor means having an entrance and exit end, a stacking means for receiving said sheets from said exit end of said conveyor means and for stacking said sheets, means for forming a gap between successive sheets, and a single insertion member for selective insertion in the direction of movement of said sheets into said gap formed in said continuous stream of shingled sheets both to separate said continuous stream of shingled sheets and to fully support the continuing stream of shingled sheets during stacking and removal of the completed stacks of sheets.

10. A system for stacking a continuous stream of shingled sheets according to claim 9, further comprising a sheet counting means disposed in the sheet path upstream of of said insertion member for successively counting the individual sheets.

11. A system for stacking a continuous stream of shingled sheets according to claim 10, said system further comprising a second conveyor means disposed upstream of said counting means for receiving said incoming sheets and conveying said sheets to said counting means.

12. A system for stacking a continuous stream of shingled sheets according to claim 10, wherein said insertion means is responsive to said counting means to separate said continuous stream of shingled sheets after a predetermined number of sheets having entered the stacking means thereby defining a completed stack of sheets.

13. A system for stacking a continuous stream of shingled sheets according to claim 9, wherein said insertion member separates the stream of shingled sheets while said sheets are positively controlled by said conveyor means.

14. A system for stacking a continuous stream of shingled sheets according to claim 13, wherein said conveyor means is concavely formed along its transverse cross-section for imparting a bow to said sheets being conveyed thereon to create a pocket between successive sheets for insertion of said insertion member.

15. A system for stacking a continuous stream of shingled sheets according to claim 14, wherein said insertion member is a spade moving along the direction of travel of said stream of bowed shingled sheets, said stream of bowed singled sheets having a center portion supported from beneath by said spade, said spade further having a forward end positioned upstream of said exit end of said conveyor and said stacking means whereby said sheets are retained in bowed configuration so that the trailing edges of said sheets are caused to snap downward past the forward end of the spade thereby creating a pocket for insertion of the spade.

16. A system for stacking a continuous stream of shingled sheets comprising a conveyor means for receiving and transporting said stream of shingled sheets, said conveyor means having an entrance end and an exit end, a stacking means including a vertically adjustable table for receiving said shingled sheets from said exit end of said conveyor means and for stacking said sheets, means for forming a gap between successive sheets, and a single insertion member for selective insertion in the direction of movement of said sheets into said gap formed in said stream of sheets to both separate said continuous stream of shingled sheets, thereby defining a completed stack of sheets, and to fully support the continuing stream of shingled sheets while said vertically adjustable table of said stacking means descends for removal of said completed stack.

17. A system for stacking a continuous stream of shingled sheets comprising a conveyor means for receiving and transporting said stream of shingled sheets, said conveyor means having an entrance end and an exit end, said conveyor means further being concavely formed along its transverse cross-section for imparting a bow to said stream of shingled sheets, a stacking means including a vertically adjustable table for receiving said shingled sheets from said exit end of said conveyor means and for stacking said sheets, and an insertion means including a spade moveable along the direction of travel of said stream of bowed shingled sheets, said stream of bowed shingled sheets having a center portion supported from beneath by said spade, said spade further having a forward end positioned upstream of said exit end of said conveyor means and said stacking means whereby the trailing edges of said sheets are caused to snap downward past the forward end of said spade creating a pocket for insertion of said spade which insertion both separates said continuous stream of bowed shingled sheets, defining a completed stack of sheets, and fully supports the continuing stream of bowed shingled sheets while said vertically adjustable table of said stacking means descends for removal of said completed stack.

18. A system for stacking a continuous stream of shingled sheets comprising a first conveyor means for receiving said shingled sheets, means for successively counting the individual sheets, a stacking means for collecting and stacking the sheets into completed stacks of a predetermined number of sheets, a second conveyor means disposed between said counting means and said stacking means for delivering the sheets to said stacking means, means for forming a gap between successive sheets, and a single reciprocating spade member positioned along the direction of travel of said stream of shingled sheets and below the sheets and having a forward end positioned upstream of said stacking means and responsive to said counting means for first separating the stream of shingled sheets upon said counting means reaching a predetermined count by extending in the direction of movement of said sheets into said gap formed in said stream of shingled sheets and then fully supporting the continuing stream of shingled sheets while the stacking means stacks the predetermined number of separated sheets into a completed stack.

* * * * *

UNITED STATES PATENT AND TRADEMARK OFFICE

CERTIFICATE OF CORRECTION

PATENT NO. : 4,652,197

DATED : March 24, 1987

INVENTOR(S) : Francis J. Littleton

It is certified that error appears in the above-identified patent and that said Letters Patent is hereby corrected as shown below:

In Column 12, line 37, the word "stacks" should be --stack--.

In Column 13, line 3, the word "singled" should be --shingled--.

Signed and Sealed this

Twenty-ninth Day of September, 1987

*Attest:*

DONALD J. QUIGG

*Attesting Officer* *Commissioner of Patents and Trademarks*